US005772481A

United States Patent [19]

Alexander, Jr. et al.

[11] Patent Number: 5,772,481

[45] Date of Patent: Jun. 30, 1998

[54] SKEG CONSTRUCTION FOR A MARINE PROPULSION UNIT

[75] Inventors: Charles F. Alexander, Jr., Austin, Tex.; Daniel F. McCormick, Oshkosh, Wis.

[73] Assignee: Brunswick Corporation, Lake Forest, Ill.

[21] Appl. No.: 718,917

[22] Filed: Sep. 25, 1996

[51] Int. Cl.[6] ..... B63H 1/18

[52] U.S. Cl. ..... 440/66

[58] Field of Search ..... 440/66, 71, 72, 440/78, 900; 114/127, 140, 141, 142, 143, 271, 274, 162

[56] References Cited

U.S. PATENT DOCUMENTS

| | | | |
|---|---|---|---|
| 3,164,121 | 1/1965 | Alexander, Jr. . | |
| 4,832,635 | 5/1989 | McCormick . | |
| 5,007,868 | 4/1991 | Fry | 114/140 |
| 5,007,869 | 4/1991 | Zoellner | 114/274 |
| 5,224,889 | 7/1993 | Hickey | 440/71 |
| 5,277,632 | 1/1994 | Davis | 440/71 |
| 5,344,349 | 9/1994 | Meisenburg et al. . | |
| 5,376,032 | 12/1994 | Meisenburg et al. . | |
| 5,516,315 | 5/1996 | Griffin | 114/274 |

*Primary Examiner*—Stephen Avila

*Attorney, Agent, or Firm*—Andrus, Sceales, Starke & Sawall

[57] ABSTRACT

A skeg assembly for a marine propulsion unit includes a generally U-shaped saddle that is removably attached to the lower torpedo section of the gearcase of the propulsion unit, and a thin wedge-shaped skeg extends downwardly from the saddle. During planing conditions of the boat, the water line is slightly below the lower torpedo section so that the saddle is out of the water. The side surfaces of the skeg having opposed water intake openings each of which is bordered rearwardly by a laterally projecting shoulder that terminates in a sharp vertical edge and the intake openings are bordered forwardly by a curved surface that connects the side surfaces of the skeg. The water intake openings communicate with a water passage in the skeg which, in turn, communicates with a water passage in the torpedo section so that water can be delivered to the cooling system of the propulsion unit.

19 Claims, 3 Drawing Sheets

SKEG CONSTRUCTION FOR A MARINE PROPULSION UNIT

BACKGROUND OF THE INVENTION

A typical marine outboard drive includes a lower gearcase that houses a vertical drive shaft and the lower portion of the gearcase is formed integrally with a generally torpedo-shaped lower section that houses the propeller shaft. The rear end of the propeller shaft projects beyond the torpedo section and carries a propeller. A skeg is formed integrally with the gearcase and projects downwardly from the torpedo section. In a typical outboard marine drive, the lower gearcase, torpedo section and skeg are integral and formed of an aluminum alloy. In order to provide the skeg with sufficient strength to withstand side thrust, as well as accidental contact with submerged objects, the skeg has a considerable thickness which can impart substantial drag to the boat or watercraft at high speed.

The normal marine propulsion unit is a totally submerged system, in which the waterline, when the boat is on plane, is substantially above the torpedo section and the propeller is totally submerged. It has been found that with high speed boats the drag caused by the torpedo section can be up to about 20% to 40% of the boat drag.

In an attempt to reduce the drag caused by the torpedo section it has been proposed to employ a full surfacing propeller system in which the propulsion unit is raised relative to the boat, so that the torpedo section at planing speed is above the waterline and only a portion, about 35%, of the propeller diameter is in contact with the water. However, it has been found that when using a single propeller in a full surfacing system, the propeller blades will impart substantial side thrust. To counteract the side thrust the skeg must necessarily ride through the water at an angle which will increase the drag imparted by the skeg.

SUMMARY OF THE INVENTION

The invention is directed to an improved skeg construction in which the skeg is removably connected to the gear case and the invention has particular application to a full surfacing, twin-propeller, propulsion unit. The propulsion unit which can either be an outboard drive, an inboard/outboard drive, or other marine drive and includes a lower gearcase that houses a vertical drive shaft. The lower portion of the gearcase is formed integrally with a generally torpedo-shaped lower section that houses, in the preferred form of the invention, a pair of concentric propeller shafts, each of which carries a propeller. The propeller on the outer propeller shaft is located forwardly of the propeller on the inner shaft.

While the gearcase and torpedo section are formed of an aluminum alloy, the skeg assembly of the invention is preferably formed of a high strength metal or alloy, preferably stainless steel, and includes a generally U-shaped saddle, which is attached to the lower flange of the drive shaft housing that connects the powerhead to the lower gearcase, and an integral thin wedge-shaped skeg extends downwardly from the saddle.

The saddle is formed with a pair of side members, each of which can be composed of a pair of legs that are mounted along the opposite sides of the gearcase. To connect the legs to the drive shaft housing flange, the upper end of each leg is formed with a cylindrical boss which receives a threaded stud and each stud extends through a flange on the drive shaft housing and receives a nut. By threading down the nuts, the saddle is drawn into tight engagement with the lower surface of the torpedo section.

As a feature of the invention, the inner surface of the saddle is provided with a pair of upwardly projecting forward pressure pads, as well as a pair of rear pressure pads. When the saddle is drawn into engagement with the torpedo section, the forward pads bear against the torpedo section a the location of an internal bulkhead, while the rear pads bear against the torpedo section at the location of a threaded ring in the rear end of the torpedo section. As the pads bear against the torpedo section a the location of the bulkheads, distortion of the aluminum-alloy torpedo section is thereby minimized.

As the saddle assembly is formed of stainless steel as opposed to an aluminum alloy, the skeg can be very thin and yet have high strength. In a preferred form of the invention, the skeg is generally wedge-shaped with the sides of the skeg diverging from each other in a rearward direction at an angle of about 2° to 5° and terminating in a blunt rear edge.

As a further feature of the invention, water inlets are formed by knife edges that extend out from the sides of the skeg to deflect water into a passage with the skeg which, in turn, communicates with a water passage in the torpedo section of the gearcase. This passage is connected via other passages in the gearcase to the water pump which is driven by the drive shaft of the engine.

The propulsion unit is mounted on the transom of the boat in a manner such that at planing speeds, the water line will coincide with the lower surface of the torpedo section, or be slightly below the torpedo section, and at this height, only about 35% of the diameter of each propeller will be in contact with the water. However, as the propulsion unit includes twin counter-rotating propellers, the side forces generated by the propellers are counteracted.

The skeg assembly of the invention, being formed of a high strength metal such as stainless steel, permits the skeg to have a very thin section which minimizes drag. As the legs of the saddle, as well as the attachment area of the saddle to the drive shaft housing, are substantially above the water line, a heavy strong attachment can be employed without a drag penalty.

The water inlets in the skeg provide an effective way to deliver water to the water pump for marine propulsion drives that use fully surfacing propellers.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
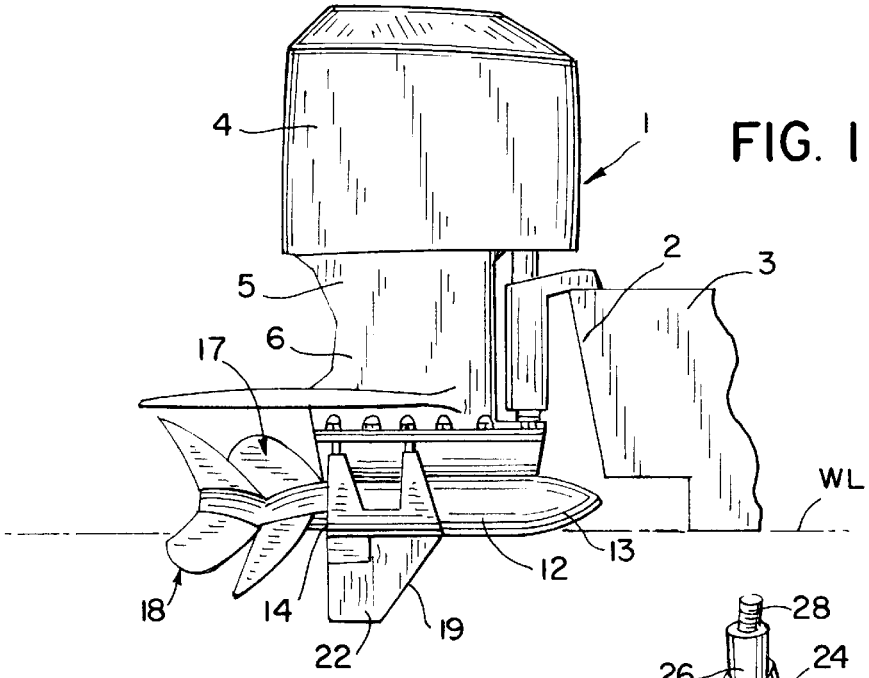
FIGS. 1 is a side elevation of a typical outboard drive marine engine incorporating the invention.

FIG. 1 illustrates a typical outboard marine drive 1, incorporating the invention, that is attached to the transom 2 of a boat or watercraft 3. While the drawings show the invention as used with an outboard drive, it is also contemplated that the invention can be employed with an inboard/outboard drive, in which the engine is located inboard of the boat, or other types of marine drive.

The outboard drive unit as illustrated, includes a powerhead 4 and an upper drive shaft housing 5 which is positioned beneath the powerhead and is connected to a lower gearcase 6. Housing 5 and gearcase 6 are provided with mating flanges 7 and 8, respectively, which are connected together by studs 9. Studs 9 are threaded within openings in the lower flange 8 and extend through openings in flange 7 and receive nuts 10.

A torpedo-shaped section 12 is formed integrally with the lower gearcase 6 and, in practice, the gearcase 6, as well as the torpedo section 12 are formed of an aluminum alloy. Torpedo section 12 includes a generally bullet-shaped or pointed forward end 13 and a rear end 14.

An outer propeller shaft 15 and a concentric inner propeller shaft 16 are mounted for rotation within torpedo section 12. Outer shaft 15 carries a propeller 17 while the inner shaft 16 carries a propeller 18 which is located to the rear of propeller 17. In practice, forward propeller 17 can be a left hand screw while rear propeller is a right hand screw. Propeller shafts 15 and 16 can be driven in the manner described in the copending U.S. Pat. application Ser. No. 08/719,633, filed Sep. 24, 1996, and entitled Twin Propeller Marine Propulsion Unit. As described in that patent application, at low speeds in the forward mode of operation of the boat, only the rear propeller 18 will be driven, and when the engine speed reaches a preselected higher value, the forward propeller 17 will also be driven, so that at high engine speeds both propellers will be operated at the same speed and in opposite directions. In reverse operation, only the rear propeller 18 will be driven and the forward propeller 17 will be free-wheeling.

The invention has particular application to a full surfacing propeller system, in which only a minor proportion of the propeller diameter is in contact with the water. In a typical full surfacing system, about 35% of the diameter of each propeller 17 and 18 will be in contact with the water when the boat is on plane. With this type of system, the water line indicated by WL in FIG. 1, will be approximately at the bottom surface of torpedo section 12, or slightly below the bottom surface of torpedo section 12.

As a feature of the invention the blades of both propellers 17 and 18 have a high rearward rake above 20° and preferably about 25°. A high rake of over 20°, is normally considered to be less efficient and detrimental to the performance of the engine, but it has been found that with a full surfacing propeller system that the high rake will not only produce a downward component of force on the propeller blades which aids in lifting the bow of the boat but also acts to dampen "porpoising" of the boat to permit the boat to run at a more favorable running angle and reduce boat drag,.

Removably connected to lower gearcase 6 is a skag assembly 19 which is preferably formed of a high strength metal or alloy, such as stainless steel. Skeg assembly 19 includes a generally U-shaped saddle 20 and a skeg 22 extends downwardly from the central or base portion 23 of saddle 20.

Saddle 20 also includes a pair of forward legs or straps 24 and a pair of rear legs or straps 25 all of which extend upwardly from base 23.

Figure 3:
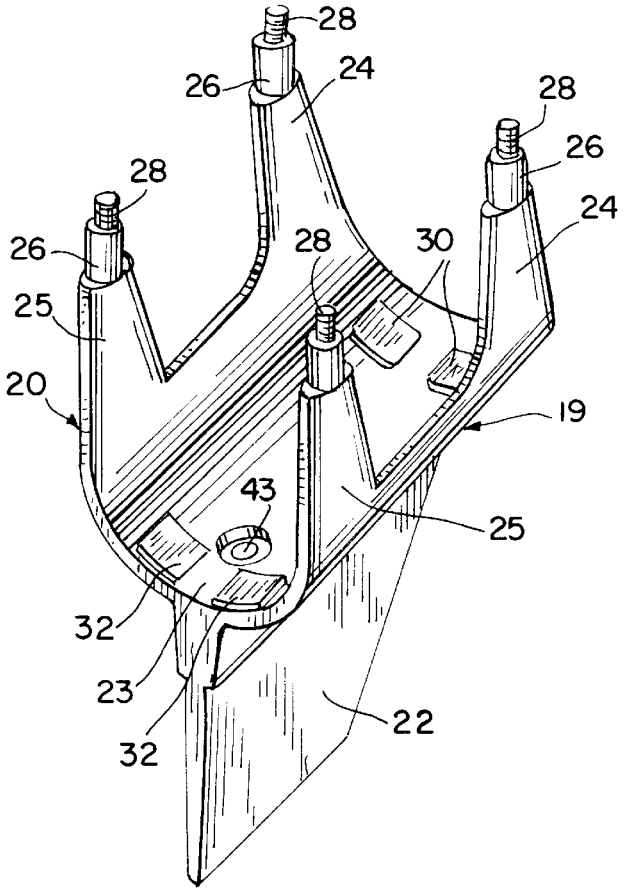
FIG. 3 is a perspective view of the skeg assembly.
Figure 2:
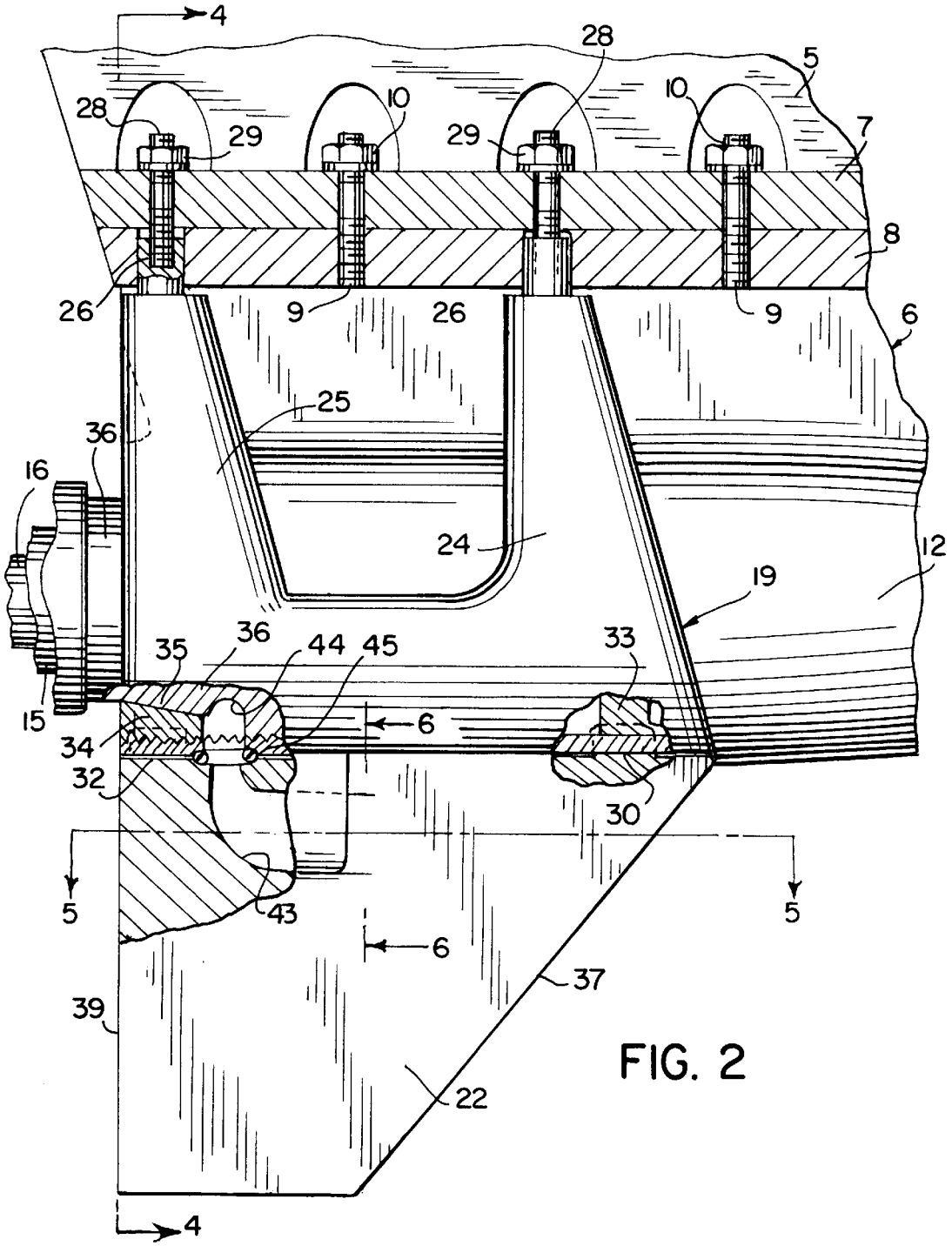
FIG. 2 is an enlarged side elevation of the lower gearcase and skeg assembly with parts broken away in section.
Figure 4:
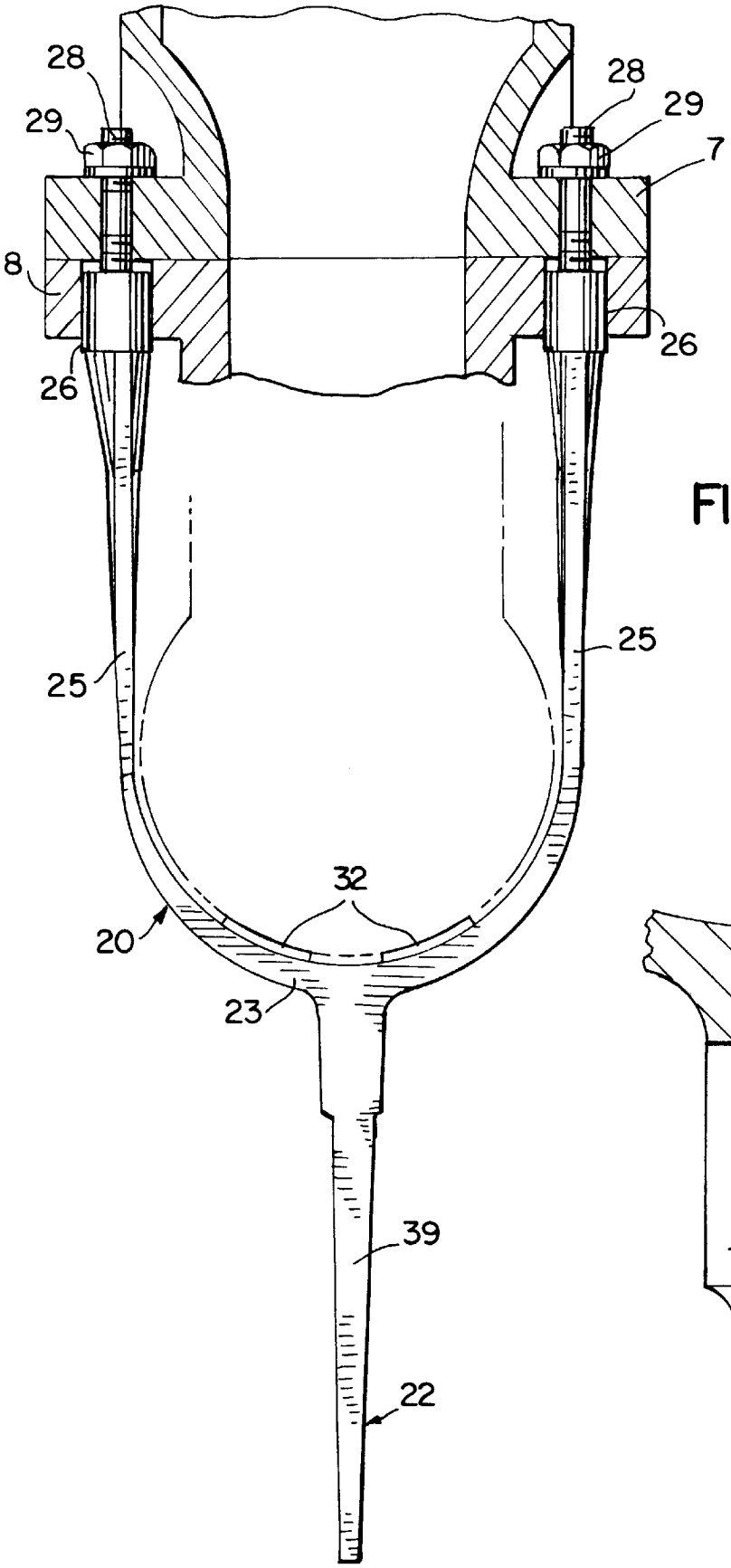
FIG. 4 is section taken along line 4—4 of FIG. 2.
Figure 6:
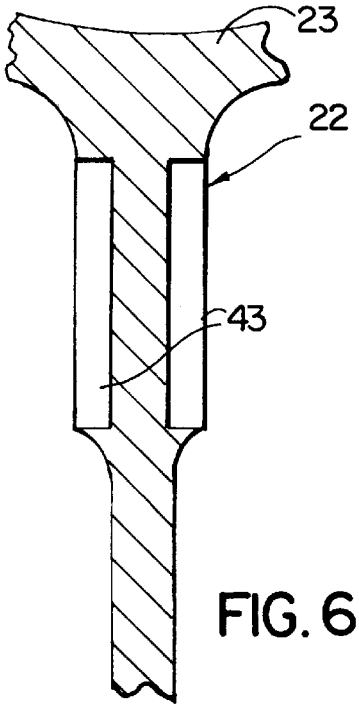
FIG. 6 is a section taken along line 6—6 of FIG. 2.

To attach saddle 20 to gearcase 6, the upper end of each leg is formed with a cylindrical section 26, as best shown in FIG. 3. An upstanding stud 28 is threaded within a hole in each section 26. Each cylindrical section 26 is located in an opening in flange 8 of gear case 6 and stud 28 passes through a hole in the flange 7 of gearcase 6. The upper ends of studs 28 receive nuts 29, as best shown in FIG. 2.

As a feature of the invention, a pair of forward pads or protrusions 30 project upwardly from the forward portion of base 23 and similarly a pair of rear pads 32 project upwardly from the rear portion of base 23. When nuts 29 are tightened down, the base 23 of saddle 20 will be drawn into engagement with the lower surface of torpedo section 12 of gearcase 6 and forward pads 30 bear against the torpedo section 12 at the location of an internal bulkhead 33 disposed in the central portion of torpedo section 12, while the rear pads 32 bear against the torpedo section a the location of a ring 34 which is threaded within the rear end of torpedo section 12. As best shown in FIG. 2, the inner tapered diameter of ring 34 bears against the tapered surface 35 of a bearing carrier 36, which is located in the rear end of torpedo section 12. As pads 30 and 32 bear against the torpedo at stiffening rings or bulkheads 33 and 34, distortion of the thin aluminum alloy torpedo section 12 is minimized as the saddle is attached to the lower gearcase 6.

Skeg 22 includes a sharp leading edge 37 which extends diagonally to the rear. Skeg 22 is wedge-shaped in cross section having a pair of sides 38 that diverge in a rearward direction at an angle of about 2° to 5°, and preferably about 3°. Sides 38 terminate in a blunt, trailing edge 39 which is located near the aft end of the of torpedo section 12.

As the skeg assembly 19 is formed of a high strength alloy, such as stainless steel, the skeg 22 can be very thin and yet have high strength. The thin, wedge-shape serves to minimize skeg drag, while maintaining directional control of the boat.

As a further feature of the invention, a water inlet system is associated with skeg 22. In this regard, sides 38 of skeg 22 are provided sharp, knife-edge shoulders 40 that are positioned laterally outward of the side surfaces 38 of the skeg. The spaces between shoulders 40 and curved surface 41 constitute water inlet openings 42. At low boat speed the water will flow around the curved surface 41 as indicated by the arrows in the upper portion of FIG. 5, to obtain a large flow area into inlet opening 42, thus reducing the water velocity through the inlet opening and decreasing the tendency of the inlet opening to plug with weeds.

Figure 5:
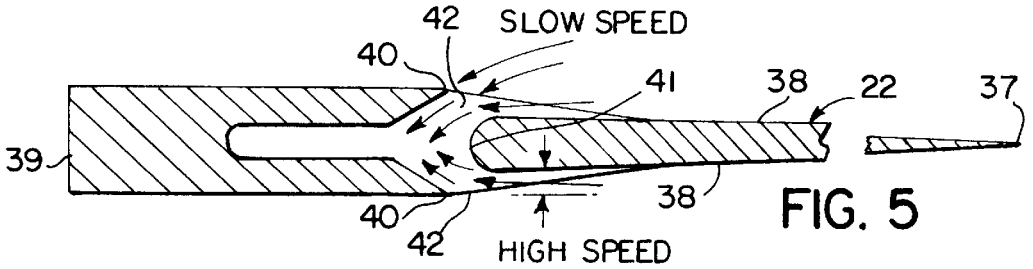
FIG. 5 is a section taken along line 5—5 of FIG. 2.

At higher boat speeds, generally above 20 to 30 mph, the water flow along the sides of the skeg is cut by the knife-edge shoulders 40, rather than following the curved surface 41, so that a smaller flow area is produced into inlet openings 42, as shown by the arrows in the lower portion of FIG. 5, Openings 42 are connected to a generally L-shaped passage 43 in skeg 22, and the upper end of passage 43 communicates with an annular passage 44 located in the torpedo section 12. As best shown in FIG. 2, passage 44 is defined by torpedo section 12, ring 34, and bearing carrier 36. Annular passage 44, in turn, is connected by drilled holes or passages in gearcase 6 with a water pump which is driven by the vertical drive shaft in a conventional manner. The joint between passages 43 and 44 is sealed by an O-ring seal 45.

With this construction, cooling water for the engine is drawn into the openings 42 in skeg 22, then flows through passages 43 and 44 to the water pump.

The invention utilizes a full surfacing propeller system, along with a high blade rake of about 25°, and twin counter-rotating propellers. This system eliminates torpedo drag due to the fact that the water level is beneath the torpedo. Further, the side forces generated by the full surfacing propellers so that the skeg is not forced to run at a high angle of attack, thus minimizing skeg drag. The high rake angle of the propeller blades acts to suppress porpoising of the boat to permit running the boat at a more favorable running angle to reduce boat drag.

As the attachment of the skeg assembly to the gearcase is above the water line, a strong heavy attachment can be employed without increasing drag while planing. The separate skeg assembly allows easy change of skeg area, angle of attack, camber, water inlet etc., to suit different engines, boats and propellers.

By incorporating the coolant water pick-up with the skeg, a simple and efficient pick-up system is provided which will permit the use of fully surfacing propellers.

We claim:

1. In a marine propulsion unit for a watercraft, a housing including a generally torpedo-shaped lower section, a propeller shaft journaled for rotation in said lower section, a propeller secured to an outer end of said propeller shaft, drive means disposed in said housing and operably connected to said propeller shaft to drive said shaft and said propeller, a generally wedge-shaped skeg extending downwardly from said lower section and having a sharp leading edge and a trailing edge and an upper end, said skeg also having a pair of opposite side surfaces, at least one of said side surfaces having a water intake port bordered rearwardly by a laterally projecting shoulder having a relatively sharp forwardly facing edge and bordered forwardly by an inwardly curved surface, said skeg having a water passage therein, said water passage having a first end communicating with said intake port and having a second end disposed at said upper end of the skeg, and water passage means disposed in said housing and communicating with the water passage in said skeg for delivering water to the cooling system of the propulsion unit.

2. The unit of claim 1, wherein the forwardly facing edge of said shoulder is disposed laterally outward beyond the lateral extremity of the portion of the skeg defining said curved surface.

3. The unit of claim 1, wherein said water intake port is disposed in both of the side surfaces of said skeg.

4. The unit of claim 3, wherein said water intake port is located in the upper portion and in the rear half of the length of said skeg.

5. The unit of claim 1, wherein said side surfaces diverge rearwardly at an angle in the range of 2° to 5°.

6. The unit of claim 1, wherein said side surfaces terminate in a blunt rear edge, said rear edge being aligned with the rear end of said lower section.

7. The unit of claim 1, and including a pair of said propeller shafts mounted concentrically of each other and journaled for rotation in said housing, a pair of said propepllers each connected to a propeller shaft, said drive means being operably connected to both of said propeller shafts in a manner to operate said propellers in opposite directions.

8. In a marine propulsion unit for a watercraft, a housing including a generally torpedo-shaped lower section, a propeller shaft journaled for rotation in said lower section, a propeller secured to an outer end of said propeller shaft, drive means disposed in said housing and operably connected to said propeller shaft to drive said shaft and said propeller, a generally wedge-shaped skeg extending downwardly from said lower section and having a sharp leading edge and a trailing edge and an upper end, said skeg also having a pair of opposite side surfaces, each of said side surfaces having an outwardly extending shoulder terminating in a relatively sharp generally vertical edge, each of said side surfaces having an intake opening located forwardly of the respective shoulder, said skeg having a surface connecting said side surfaces and disposed forwardly of said intake openings, said skeg also having an internal water passage, said internal passage having a first end communicating with said intake openings and having a second end disposed at the upper end of said skeg, and water passage means disposed in said housing and communicating with the second end of the water passage in said skeg for delivering water to the cooling system of the propulsion unit.

9. In a marine propulsion unit for a watercraft, a lower housing including a generally torpedo-shaped lower section, a propeller shaft journaled within said lower section and having a rear end projecting from said lower section, a propeller mounted on the projecting rear end of said propeller shaft, drive means disposed in said housing and operably connected to said propeller shaft for driving said propeller shaft and said propeller, a separate skeg unit including a generally U-shaped saddle composed of a pair of side members and a web portion connecting said side members, said skeg unit also including a skeg extending downwardly from said web portion, said web portion disposed beneath the lower section of said housing and said side members disposed along the sides of said lower section, and connecting means disposed above the lower end of said lower section for removably connecting said side members to the sides of said housing.

10. The unit of claim 9, wherein each side member includes a pair of longitudinally spaced legs, each leg being flexible in a direction toward and away from the axis of said lower section.

11. The unit of claim 10, and including a generally cylindrical boss disposed on the upper end of each leg, a threaded member extending upwardly from each boss, said housing having an outwardly extending flange, said flange having a plurality of openings to receive said threaded members, and a fastener threaded on the upper end of each threaded member and engaged with the upper surface of said flange to thereby removably connect said skeg unit to said housing.

12. The unit of claim 11, wherein said flange is disposed a substantial distance above said lower section.

13. The unit of claim 12, and including a second housing disposed upwardly of said first housing and having a second flange disposed in contiguous relation with said first flange, a plurality of second threaded members threaded within openings in said first flange and extending through holes in said second flange, and a plurality of second fasteners each threadedly engaged with the upper end of each second threaded member to thereby secure said lower housing to said upper housing.

14. The unit of claim 9, and including a water inlet disposed in said skeg, a first water passage disposed in said skeg and having a first end connected to said water inlet and having a second end terminating in said saddle, and a second water passage disposed in said lower section and communicating with said first water passage, whereby water entering said water inlet will flow through said first water passage to said second water passage for delivery to the cooling system of said propulsion unit.

15. The unit of claim 14, and including sealing means for sealing the joint between said first water passage and said second water passage.

16. The unit of claim 9, wherein the propulsion unit is positioned relative to the watercraft such that the water line is located slightly beneath said lower section and said saddle is above said water line when the watercraft is on plane.

17. The unit of claim 9, and including a first annular reinforcing member disposed in said lower section, a second annular reinforcing member disposed in said lower section and spaced rearwardly of said first reinforcing member, a first pad disposed on an inner surface of said saddle and disposed to engage the outer surface of said lower section at a location aligned with said first reinforcing member, and a second pad disposed on the inner surface of said saddle and disposed to engage the outer surface of said lower section at a location aligned with said second reinforcing member.

18. The unit of claim 17, and including a pair of said first pads aligned with said first reinforcing member and a pair of said second pads aligned with said second reinforcing member.

19. In a marine propulsion unit for watercraft, a housing including a generally torpedo-shaped lower section, a propeller shaft journaled for rotation in said lower section, a propeller secured to an outer end of said propeller shaft, drive means disposed in said housing and operably connected to said propeller shaft to drive said shaft and said propeller, a thin skeg extending downwardly from said lower section and having a sharp leading edge and a trailing edge and an upper end, said skeg also having a pair of opposite side surfaces, at least one of said side surfaces having a water intake port bordered rearwardly by a laterally projecting shoulder and bordered forwardly by a forward generally transverse surface, said skeg having a water passage therein, said water passage having a first end communicating with said intake port and having a second end disposed at said upper end of the skeg, and water passage means disposed in said housing and communicating with the water passage in said skeg for delivering water to the cooling system of the propulsion unit.

* * * * *